US008490784B2

(12) United States Patent
Cortesi

(10) Patent No.: US 8,490,784 B2
(45) Date of Patent: Jul. 23, 2013

(54) ARTICLE FOR SMOKERS

(75) Inventor: Pierpaolo Cortesi, Bologna (IT)

(73) Assignee: On-Off Cigarette S.r.l., Ozzano dell' Emilia (Bologna) (IT)

( * ) Notice: Subject to any disclaimer, the term of this patent is extended or adjusted under 35 U.S.C. 154(b) by 0 days.

(21) Appl. No.: 13/519,605

(22) PCT Filed: Dec. 22, 2010

(86) PCT No.: PCT/IB2010/056007

§ 371 (c)(1),
(2), (4) Date: Jun. 28, 2012

(65) Prior Publication Data

US 2012/0285846 A1 Nov. 15, 2012

(30) Foreign Application Priority Data

Dec. 29, 2009 (IT) ..... BO09A0834

(51) Int. Cl.
*A24F 13/20* (2006.01)

(52) U.S. Cl.
USPC ..... 206/86; 206/85; 206/136; 220/345.4; 131/250; 131/248

(58) Field of Classification Search
USPC ..... 206/85, 86, 87, 120, 136, 246; 131/231, 131/233, 248, 250, 249, 256; 220/345.1, 220/345.2, 345.4
See application file for complete search history.

(56) References Cited

U.S. PATENT DOCUMENTS

| | | | | |
|---|---|---|---|---|
| 2,008,001 | A * | 7/1935 | Burnham | 206/536 |
| 2,613,859 | A * | 10/1952 | Boudreau | 223/109 R |
| 3,888,264 | A | 6/1975 | Baclit | |
| 4,223,687 | A * | 9/1980 | Sandeen | 131/180 |
| 4,897,033 | A * | 1/1990 | Yang | 431/253 |
| 5,605,226 | A | 2/1997 | Hernlein | |
| 8,091,557 | B2 * | 1/2012 | Cortesi | 131/249 |
| 2003/0172943 | A1 * | 9/2003 | Connolly | 131/250 |
| 2004/0216753 | A1 * | 11/2004 | Fox | 131/242 |

FOREIGN PATENT DOCUMENTS

| | | | |
|---|---|---|---|
| CA | 2586995 | A1 | 10/2008 |
| CA | 2587072 | A1 | 10/2008 |

(Continued)

OTHER PUBLICATIONS

International Search Report for PCT/IB2010/056007, Mailed Apr. 26, 2011, 4 pages.

*Primary Examiner* — David Fidei
(74) *Attorney, Agent, or Firm* — William J. Sapone; Ware Fressola Maguire & Barber LLP

(57) ABSTRACT

An article for smokers comprises a main body (1) of elongate form exhibiting a first end (11) and a second end (12). The main body (1) has a cavity (4) accessible from outside at the second end (12) adapted for receiving the lit end portion of a cigarette. An element (5), which is associated to the second end (12), is provided with a base (51) and with a cutting profile (52) for cutting the cigarette. The element (5) is translatable with respect to the second end (12) of the main body (1) between an open position (A) of the cavity (4) of the main body (1) and a closed position (C) of the cavity (4), with the displacement of the element (5) from the open position (A) to the closed position (C) determining the cutting of the cigarette by means of the cutting profile (52).

14 Claims, 2 Drawing Sheets

FOREIGN PATENT DOCUMENTS

| | | | |
|---|---|---|---|
| FR | 2684523 | A2 | 6/1993 |
| FR | 2915352 | A1 | 10/2008 |
| WO | WO2007/005488 | A2 | 1/2007 |
| WO | WO2009/016461 | A2 | 2/2009 |

* cited by examiner

A
C
P1
P2
X
IX

ARTICLE FOR SMOKERS

TECHNICAL FIELD

The invention concerns the technical sector relating to accessories and articles for smokers.

DESCRIPTION OF THE BACKGROUND ART

Various types of articles for smokers are known which can contemporaneously contain a lighter and one or more unconsumed cigarettes, or which are provided with accessories which can be used to extinguish the cigarette, and exhibit suitable compartments into which cigarette ends can be inserted temporarily.

For example, articles for smokers are known consisting of a main body which is provided with at least a housing accessible from the outside, for inserting and positioning a lighter; an elongate cavity which is accessible from the outside, for example for containing a cigarette to be smoked; and an accessory which is provided with a cutting profile for cutting off the lit end of the cigarette which the smoker wishes to extinguish.

In particular, articles for smokers are known in which a suitable container is also provided in the main body, the container being accessible from the outside, and the lit end of the cigarette can be positioned therein, while a cutting element is present at the container, is movable with respect to the main body and is destined to be used to detach the lit part, once inserted into the container, from the remaining part of the cigarette.

Usually, in articles for smokers exhibiting a container for extinguishing the ember and for housing the lighter, the movable cutting element for cutting the lit part of the cigarette also serves as a closure and sealing element of the container, within which container the cut-off ember remains, after it has been detached from the cigarette.

The ways in which the movable cutting element in current articles for smokers is associated to the main body, and is made translatable with respect to the ember container, do not ensure the perfect hermetic closure of the container.

Further, since such articles are subjected to intense, frequent use, smokers particularly feel the need for an article which is durable, and which enables them to handle and move the movable cutting element in a totally simple, direct way—even using only a single finger of one hand—firstly to render the ember compartment accessible, and subsequently, after the lit part of the cigarette has been inserted in the container, to cut and detach the lit part of the cigarette from the remaining part of the cigarette, thereby closing the container with the ember to be extinguished inside.

SUMMARY OF INVENTION

An aim of the invention is therefore to make available an article for smokers which is capable of obviating the drawbacks which are present in previously-described articles in the prior art.

In particular, an aim of the invention is to make available an article for smokers, comprising:

a main body having an elongate shape exhibiting a first end and a second end;

a first housing realized internally of the main body and accessible from outside at said first end, said first housing exhibiting dimensions such as to be able to receive and contain an accessory for smokers;

a cavity realized in the main body and accessible from outside at said second end, said cavity exhibiting such dimensions as to be able to completely receive internally thereof a lit end portion of a cigarette;

an element provided with a base and a cutting profile for cutting the cigarette;

the article for smokers being characterized in that the second end of said main body is provided with a first coupling profile and in that the base of said element is provided with a second coupling profile, the first profile and the second profile exhibiting a form and shape which are mutually complementary such that said element can be coupled by means of the base to said second end, translatably with respect to the second end and remaining in strict reciprocal adherence thereto, and in that the element is provided with an internal groove exhibiting a first end wall and a second end wall and in that a limiting organ of the translation of the element is predisposed in the second end of the main body such as to project therefrom and involve said groove in order to limit translation of the element with respect to the second end of the main body between an open position of the cavity, in which the organ is abutting against the first end wall of the groove, in order to enable introduction into the cavity of the lit end portion of the cigarette, and a closed position of the cavity, in which the organ is abutting against the second end wall of the groove, in order to enable the element to occlude the cavity with the base thereof, with a displacement of the element from the open position to the closed position which determines a cutting of the cigarette by the cutting profile.

The article of the invention makes available a mobile element for cutting the lit part of a cigarette, which element is also utilizable for opening and closing the compartment for containing the ember, and which, thanks to the particular ways in which the element is coupled to the main body, ensures effective hermetic closure of the cavity, while at the same time preserving ease of handling.

Other characteristics of the article for smokers which is the subject of the invention are disclosed in the various dependent claims.

BRIEF DESCRIPTION OF THE DRAWINGS

The characteristics of the article for smokers, the object of the invention, will emerge in greater detail from the following description, with the aid of the appended figures of the drawings, in which.

DESCRIPTION OF THE PREFERRED EMBODIMENTS

Figure 4:
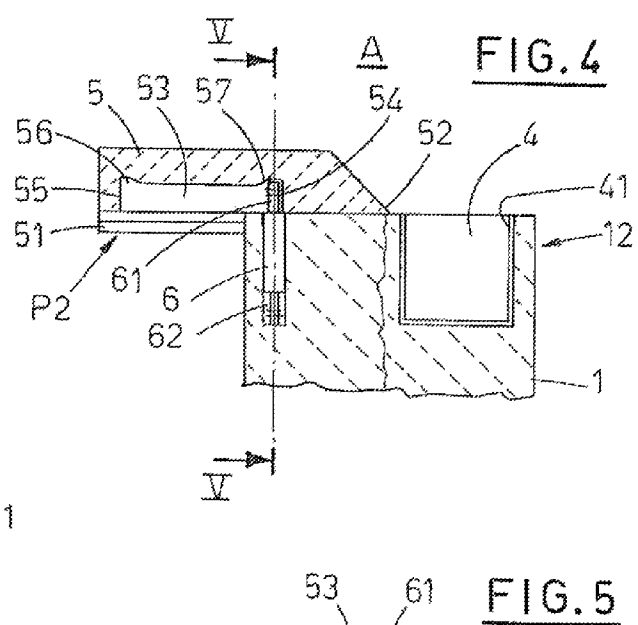
FIG. 4 is a section view along the line IV-IV of FIG. 3.

The article for smokers which is made available by the invention is constituted by a main body (1), for example made of plastic or metallic material, which is possibly covered with leather, textile or other material, is of elongate form and exhibits a first end (11) and a second end (12).

A first service housing (2) is realized in the main body (1) and is externally accessible at the first end (11).

The dimensions of the first housing (2) are such that it is capable of receiving and containing an accessory for smokers, for example a lighter (3). The dimensions of the first housing (2) can be such as to accommodate a disposable commercial lighter, or a rechargeable lighter which satisfies current safety regulations (for example EN 138692002, and UNI 9994-2006).

Alternatively, based on the smoker's requirements or personal preferences, the first housing (2) can be used to contain a cigarette or a cigar or other object.

The article for smokers further exhibits a cavity (4), also realized in the main body (1) and accessible from the outside at the second end (12).

The dimensions of the cavity (4) enable it to fully internally receive the lit end portion of a cigarette. The smoker may wish to detach this portion from the remaining part of the cigarette when he/she wants to extinguish the cigarette, either because the cigarette is completely consumed, or because the smoker is in a place where smoking is not allowed and he/she wishes to preserve unaltered the part which has not yet been consumed, in order to smoke it at a later time in a place where smoking is not restricted.

In this connection, the article for smokers which is the subject of the invention exhibits an element (5) which is provided with a base (51), the base (51) being joined to the second end (12) of the main body (1), and also exhibits a cutting profile (52) for cutting and detaching the cigarette.

In detail, the second end (12) of the main body (1) is provided with a first coupling profile (P1) and the base (51) of the element (5) exhibits a second coupling profile (P2). The first profile (P1) of the second end (12) of the body (1) and the second profile (P2) of the base (51) respectively exhibit a shape and form which are mutually complementary, such that the element (5) can, by means of the base (51), be coupled to the second end (12) translatably with respect to the second end (12) while remaining in strict reciprocal adherence thereto (see for example FIGS. 4 and 5).

Further, the element (5) is provided with an internal groove (53) which exhibits a first end wall (54) and a second end wall (5), while a limiting organ (6) for limiting the translation of the element (5) is predisposed in the second end (12) of the main body (1) so as to project therefrom, into the groove (53) in order to limit the translation of the element (5) with respect to the second end (12) of the main body (1).

The presence of the limiting organ (6) projecting from the second end (12) and inserted in the groove (53) of the base (51) of the element (5), imposes and limits the possibility of translation of the element (5) with respect to the main body (1) of the article for smokers between:

an open position (A) of the cavity (4), in which the limiting organ (6) is abutting against the first end wall (54) of the groove (53), to enable the introduction of the lit end portion of the cigarette into the cavity (4) (see for example FIGS. 2, 4, 7A and 9);

and a closed position (C) of the cavity (4), in which the limiting organ (6) is abutting against the second end wall (55) of the groove (53), in order to enable the element (5) to occlude the cavity (4) with the base (51) of the element (5);

while the displacement of the element (5) from the open position (A) to the closed position (C) determines the detachment of the ember by means of the cutting profile (52) and the consequent containment of the ember inside the cavity (4) (see for example FIGS. 1 to 6).

The first coupling profile (P1) which is present in the second end (12) of the main body (1) exhibits a projection, while the second coupling profile (P2) which is realized in the base (51) of the element (5) exhibits a recess.

Figure 5:
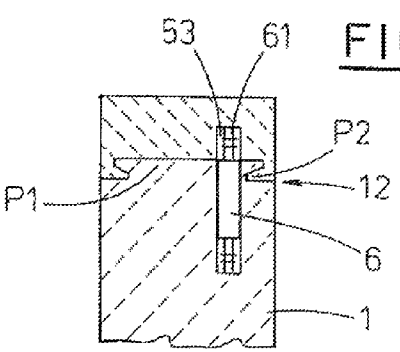
FIG. 5 is a section view along the line V-V of FIG. 4.
Figure 2:
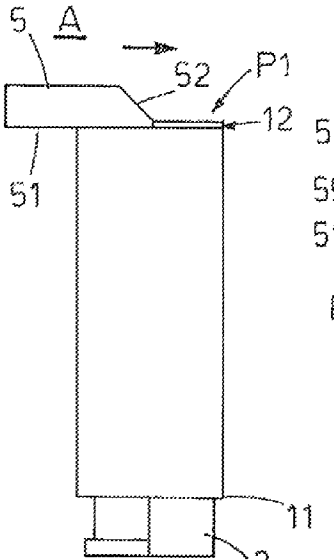
FIG. 2 is a lateral view of the article of FIG. 1, in an inverted position, in a specific use configuration.
Figure 3:
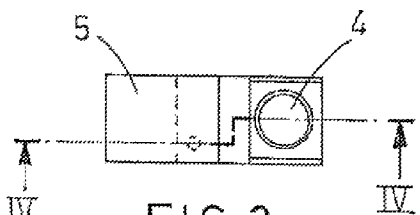
FIG. 3 is a plan view of the article of FIG. 2.
Figure 1:
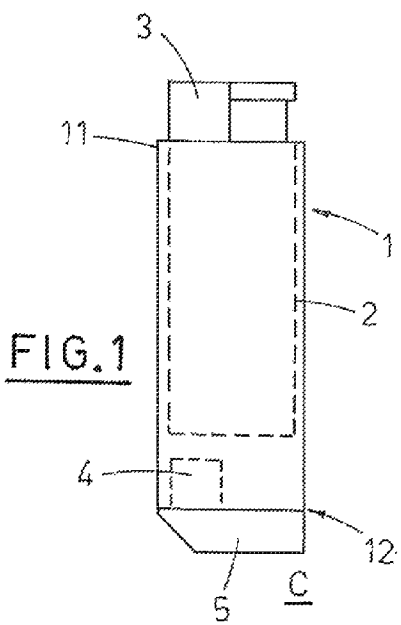
FIG. 1 is a lateral view of the article for smokers which is the subject of the invention in a first embodiment.
Figures 6, 7A, 7B, 8A, 8B, 9, 10:
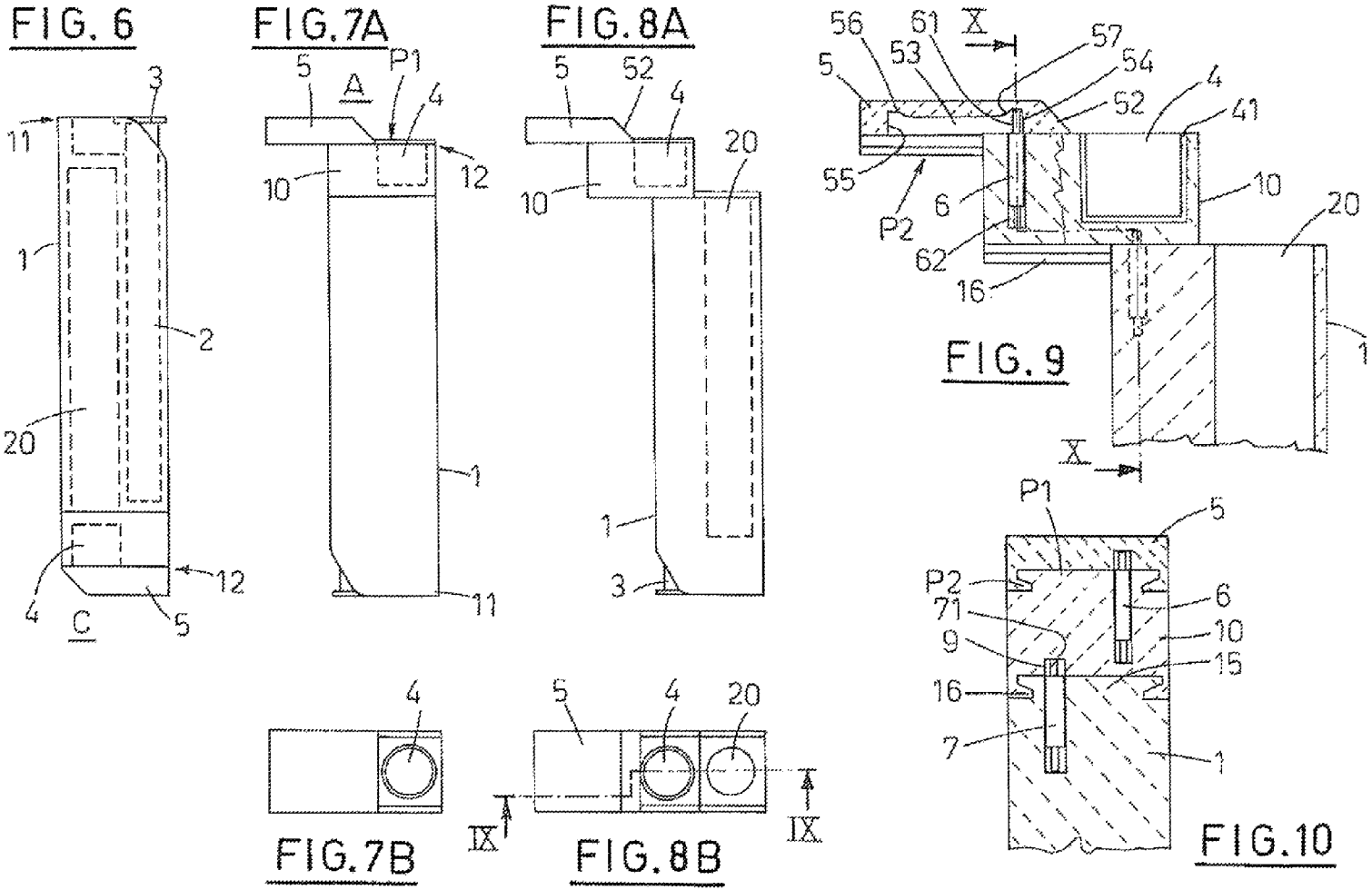
FIG. 6 is a side view of a second possible embodiment of the article for smokers which is the subject of the invention.
FIG. 7A is a side view of the article of FIG. 6, in an inverted position, and in a specific use configuration.
FIG. 7B is a plan view of the article of FIG. 7A.
FIG. 8A is a side view of the article of FIG. 7A in a further use configuration.
FIG. 8B is a plan view of the article of FIG. 8A.
FIG. 9 is a section view along the line IX-IX of FIG. 8B.
FIG. 10 is a section view along the line X-X of FIG. 9.

As shown in greater detail in FIGS. 5 and 10, the projection of the first profile (P1) is dove-tail shaped, while the recess of the second profile (P2) is shaped complementarily to the dove-tail shape of the first profile (P1). The first profile (P1) and the second profile (P2) exhibit a shape and form which are reciprocally complementary, such that the base (51) of the element (5) can be made to translate with respect to the body (1), between the two above-described extreme positions, an open position (A) and a closed position (C), while continuing to remain in strict reciprocal adherence thereto.

In particular, the first profile (P1) and the second profile (P2) are made in such a way as to exhibit a complementary shape and form which "force" the base (51) to adhere perfectly, with a slight interference, to the second end (12) of the main body (1), while maintaining the possibility of easily translating the element (5) with respect to the body (1).

These particular ways of coupling the element (5) to the main body (1) (between the base (51) of the element (5) and the second end (12) of the main body (1)) mean that when the element (5) is translated to occlude the cavity (4) (closed position (C)), the cavity (4) is hermetically sealed from the external environment, thus immediately extinguishing the ember, given the absence of oxygen.

In this connection, the cavity (4) in which the lit part of the cigarette can be inserted is advantageously coated with appropriate fireproof material (41), for example by inserting a metal or steel pipe which can stand temperatures in excess of even 800° C. without any alteration.

The limiting organ (6) for limiting the translation of the element (5) with respect to the second end (12) of the main body (1) is fixed in a seating (62) realized in the main body (1) at the second end (12), and exhibits a head (61) projecting from the second end (12) and exhibiting dimensions which are suitable for insertion into the groove (53).

To stabilize the two extreme positions (open position (A) and closed position (C)) between which the element (5) is translatable with respect to the main body (1), the groove (53) exhibits niches (56, 57) at the first end wall (54) and the second end wall (55), while the head (61) of the limiting organ (6) is elastically movable with respect to the organ (6), for example due to the presence of a spring.

In this way the head (61) can be compressed and lowered, when it is inserted in the groove (53), for example during the translation of the element (5) from the closed position (C) to the open position (A) or vice versa, while the head (61) is released, and therefore rises, when it abuts against the first end wall (54) and the second end wall (55), occupying and inserting between the niches (56, 57).

This produces an "engagement" effect, as a result of the compression of the head when the head is forced to pass from one of the two niches (56, 57) to the groove as a consequence of the translation of the element (5) from the closed position (C) to the open position (C) and vice versa.

The limiting organ (6) of the translation of the element (5) with respect to the second end (12) of the main body (1) can be constituted by a spring-loaded pin.

The ways in which the article for smokers can be used are as follows.

In normal conditions of non-use of the article by the smoker, the element (5) is in the closed position (C).

If after lighting the cigarette it becomes necessary to extinguish it before it is completely consumed, or if the cigarette has been consumed completely but no ashtray or appropriate container is available for its disposal, the smoker, while holding the article with the second end (12) of the body facing upwardly, can use a thumb to push the mobile element (5), such that with respect to the body (1) it translates from the closed position (C) to the open position (A).

To obtain the translation of the element (5), a slight pushing pressure must be exerted upon the element (5) in order to elastically force the head (61) to compress, leave the niche (56) and descend to occupy the groove (53) until the first end wall (54) is reached.

The translation of the element (5) with respect to the main body (1) ends when the first end wall (54) of the groove (53) is abutting against the head (61). The head (61) is no longer subject to the elastic compression of the spring and can move to occupy the niche (57), thus stabilizing the position of the element (5) (open position (A); see FIG. 4 or FIG. 9).

The smoker can then introduce the lit end part of the cigarette into the cavity (4) and subsequently push the element (5) in an opposite direction, translating the element (5) with respect to the body (1) from the open position (A) to the closed position (C) until the second end wall (55) of the groove is abutting against the head (61).

During the translation of the element (5) towards the closed position (C), the relative cutting profile (52) cuts the part of the cigarette which remains outside he cavity (4) from the lit part (ember), which instead is contained inside the cavity (4).

In this way, when the element (5) reaches the closed position (C) (the second end wall (55) of the groove (53) abutting against the head (61) of the limiting organ of the translation of the element (5)), the cavity (4) is completed occluded and absolutely hermetically closed by the base (51) of the element (5), thereby enabling the ember which is contained therein to be extinguished rapidly.

The above-described ways of using the article for smoker are completely safe, since the smoker never comes into contact with the lit part of the cigarette. Further, once the ember is detached from the cigarette it remains completely hermetically enclosed inside the cavity and is extinguished immediately, given the absence of oxygen.

Further, the fact that opening or closing the cavity (49) requires a pushing action to be exerted upon the mobile element (5) to elastically force the head (61) to descend from the niches (56, 57) and occupy the groove (53), the translation of the mobile element (5) enables the article for smokers to respect the minimal safety measures which are necessary should children use the article accidentally and improperly.

FIGS. 6 to 10 show a possible further embodiment of the article for smokers which is the subject of the invention, which embodiment is particularly advantageous and useful when the smoker has not completely consumed the cigarette and wishes to do so at a later time.

In this variant, the main body (1) is provided with a second service housing (20) and a part (10) of the main body (1), in which part (10) the cavity (4) is realized, in which cavity (4) the lit end part of a cigarette can be inserted, which part (10) is also translatable with respect to the main body (1), such that the second housing (20) becomes accessible from the outside (see for example FIG. 8A).

The second housing (20) exhibits such dimensions as to receive for example a whole or a cut cigarette, a further spare lighter or other accessory.

The part (10) of the body (1) is translatable with respect to the body (1) independently of the translation of the element (5). In this way, without having to open or close the cavity (4) beforehand, the second housing (20) can be made accessible from the outside in order to place a cigarette therein, to collect a cigarette previously placed therein, or to collect/store a spare lighter, should the lighter (3) which was originally placed in the first housing (2) have stopped working because it is empty.

In this connection, the main body exhibits a dove-tail profile (15) and the part (10) that is translatable with respect to the main body (1) is provided with a recess (16) exhibiting a profile which is shaped complementarily to the dove-tail profile (15) of the main body (1) (see for example FIG. 10).

Further, to limit the translation of the translatable part (10) with respect to the body (1), the translatable part (10) exhibits a slot (9) and the main body is provided with a translation limiting organ (7) exhibiting a head (71) which inserts in the slot (9).

The slot (9) is further provided with a first end wall and a second end wall for the head (71) of the translation limiting organ (7) to abut against in order to limit the translation of the translatable part (10) with respect to the main body (1).

The slot (9) also exhibits recesses at the first end wall and the second end wall thereof, and the head (71) of the translation limiting organ (7) for limiting the translation of the translatable part (10) is elastically movable with respect to the translatable part (10), and can be compressed and lowered when inserted in the slot (9), and raised again when abutting against the first end wall and the second end wall of the slot (9), thus occupying the said recesses.

In this further possible variant, the element (5) is associated to and translatable with respect to the translatable part (10) of the body (1) in the same ways as are described herein above with reference to FIGS. 1 to 5.

Advantageously, this variant of the article for smokers is extremely versatile, since it enables the ember to be contained inside the cavity (4) once the lit part of the cigarette has been detached, consequently rapidly extinguishing the ember, while the remaining detached part of the cigarette, whether or not totally consumed, is stored inside the second housing (20).

Further, in accordance with the particular requirements or preferences of the smoker, either both the first housing (2) and the second housing (20) can be used to contain whole, unconsumed cigarettes, or the first housing (2) can be used to contain a lighter and the second housing can be used to contain a whole unconsumed cigarette, to store a not completely-consumed cigarette, which the smoker wishes to reuse at a later time, or the end of a completely-consumed cigarette (should the smoker be in a place where no appropriate disposal containers are available), or even a second spare lighter.

Finally, in a further possible variant (not shown), the central body (1) may, in both the embodiment of FIGS. 1 to 5, and the embodiment of FIGS. 6 to 10, exhibit a tab by means of which the central body (1) can be attached to a pack of cigarettes, or to a belt or bag.

The tab can be solidly constrained to the central body or it could be attached thereto by welding, gluing or other means for reciprocal attachment.

From the foregoing description it emerges that the ways in which the element (5) is coupled to the second end (12) of the body (1), and made translatable with respect to the second end (12) between an open position (A) and a closed position (C) of the cavity (4) for containing the lit part of the cigarette (ember), ensure ease of handling, together with perfect air tightness and hermetic closure of the cavity (4). This facilitates immediate extinguishing of the ember which is contained therein.

The foregoing description is intended by way of a non-limiting example, and any modifications to details and/or design of the elements of the article for smokers of the invention which may become necessary for technical and/or functional reasons are considered to fall within the ambit of protection as it is defined in the appended claims.

The invention claimed is:

1. An article for smokers, comprising:

a main body (1) having an elongate shape exhibiting a first end (11) and a second end (12);

a first housing (2) realized internally of the main body (1) and accessible from outside of said first end (11), said first housing (2) having dimensions adapted to receive and contain an accessory for smokers;

a cavity (4) realized in the main body (1) and accessible from outside of said second end (12), said cavity (4) having dimensions adapted to completely receive internally thereof a lit end portion of a cigarette;

an element (5) provided with a base (51) and a cutting profile (52) for cutting the cigarette;

wherein the second end (12) of said main body (1) is provided with a first coupling profile (P1), the base (51) of said element (5) being provided with a second coupling profile (P2), the first coupling profile (P1) and the second coupling profile (P2) exhibiting a form and shape which are mutually complementary such that said element (5) can be coupled by the base (51) to said second end (12), translatably with respect to the second end (12) and remain in strict reciprocal adherence thereto, and in that the element (5) is provided with an internal groove (53) exhibiting a first end wall (54) and a second end wall (55) and in that a limiting organ (6) for limiting the translation of the element (5) is predisposed in the second end (12) of the main body (1) so as to project therefrom and engage said groove in order to limit translation of the element (5) with respect to the second end (12) of the main body (1) between an open position (A) of the cavity (4), in which the limiting organ (6) is abutting against the first end wall of the groove (53), in order to enable introduction into the cavity (4) of the lit end portion of the cigarette, and a closed position (C) of the cavity (4), in which the limiting organ (6) is abutting against the second end wall of the groove (53), in order to enable the element (5) to occlude the cavity (4) with the base (51) thereof, with a displacement of the element (5) from the open position (A) to the closed position (C) causing a cutting of the cigarette by the cutting profile (52).

2. The article of claim 1, wherein the first coupling profile (P1) present in said second end (12) of the main body (1) comprises a projection and in that the second coupling profile (P2) present in the base (51) of said element (5) comprises a recess.

3. The article of claim 2, wherein the projection of the first coupling profile (P1) is shaped as a dove-tail and in that the recess of the second coupling profile (P2) is shaped complementarily to the dove-tail of the first coupling profile (P1).

4. The article of claim 1, wherein the cavity (4) in which the lit part of the cigarette is insertable is coated with a fire-resistant material (41).

5. The article of claim 1, wherein the limiting organ (6) is fixed in a seating (62) realized in the main body (1) at the second end (12) and exhibits a head (61) projecting from said second end (12) and having dimensions adapted for insertion in the groove (53).

6. The article of claim 5, wherein said groove (53) exhibits niches (56, 57) at the first end wall (54) and the second end wall (55) and in that the head (61) of the limiting organ (6) is elastically movable with respect to the limiting organ (6) and can be compressed and lowered when inserted in said groove (53) and is releasable and raisable when abutting against the first end wall (54) and the second end wall (55), occupying said niches (56, 57).

7. The article of claim 1, wherein said first housing (2) is dimensioned so as to enable insertion and positioning of a lighter (3) therein.

8. The article of claim 1, wherein said first housing (2) is dimensioned so as to enable insertion and positioning of a cigarette therein.

9. The article of claim 1, wherein the main body (1) exhibits a second housing (20) and wherein a part (10) of the main body (1) affording the cavity (4), into which the lit end of a cigarette can be inserted, is translatable with respect to the main body (1) in such a way as to make the second housing (20) accessible from outside.

10. The article of claim 9, wherein the second housing (20) is dimensioned so as to receive a cigarette, either whole or cut, or a lighter or another accessory.

11. The article of claim 9, wherein the main body (1) exhibits a dove-tail profile (15) and in that the translatable part (10) is provided with a recess (16) exhibiting a shaped profile which is complementarily-shaped to the dove-tail profile (15) of the main body (1).

12. The article of claim 11, wherein the translatable part (10) exhibits a slot (9), the main body (1) having a translation limiting organ (7) for limiting the translation of the translatable part (10) with respect to the main body (1), the translation limiting organ (7) being provided with a head (71) insertable in the slot (9).

13. The article of claim 12, wherein the slot (9) is provided with a first abutting end and a second abutting end for engaging the head (71) of the translation limiting organ (7).

14. The article of claim 13, wherein the slot (9) exhibits recesses at the first abutting end and the second abutting end thereof and in that the head (71) of the translation limiting organ (7) is elastically movable with respect thereto and can be compressed and lowered when inserted in the slot (9) and releasable and raisable when abutting against the first abutting end and the second abutting end of the slot (9), occupying said recesses.

* * * * *